US008366492B2

(12) United States Patent
Erickson et al.

(10) Patent No.: US 8,366,492 B2
(45) Date of Patent: Feb. 5, 2013

(54) TERMINAL REVERSING BLOCK

(75) Inventors: John W. Erickson, Crystal Lake, IL (US); James A. Erickson, Crystal Lake, IL (US); John Walter Erickson, Crystal Lake, IL (US)

(73) Assignee: Boltswitch, Inc., Crystal Lake, IL (US)

( * ) Notice: Subject to any disclaimer, the term of this patent is extended or adjusted under 35 U.S.C. 154(b) by 0 days.

(21) Appl. No.: 12/974,669

(22) Filed: Dec. 21, 2010

(65) Prior Publication Data

US 2011/0147175 A1 Jun. 23, 2011

Related U.S. Application Data

(60) Provisional application No. 61/288,805, filed on Dec. 21, 2009.

(51) Int. Cl.
*H01R 9/22* (2006.01)

(52) U.S. Cl. ..... 439/709; 200/51.09; 200/237; 361/823

(58) Field of Classification Search ..... 200/51.09, 200/237; 439/709; 361/823
See application file for complete search history.

(56) References Cited

U.S. PATENT DOCUMENTS

| | | | | |
|---|---|---|---|---|
| 4,363,063 | A | 12/1982 | Erickson | |
| 4,536,046 | A | 8/1985 | Erickson | |
| 5,588,880 | A * | 12/1996 | Wood | 439/709 |
| 6,129,595 | A * | 10/2000 | Scanlon et al. | 439/716 |
| 7,039,183 | B2 * | 5/2006 | Zielke et al. | 379/413.04 |
| 7,604,516 | B2 * | 10/2009 | Adunka et al. | 439/709 |
| 7,786,831 | B2 * | 8/2010 | Oh | 335/202 |
| 7,837,517 | B2 * | 11/2010 | Lewis | 439/709 |

* cited by examiner

*Primary Examiner* — Gary F. Paumen
(74) *Attorney, Agent, or Firm* — Cook Alex Ltd.

(57) ABSTRACT

A terminal reversing block mounts to a standard electrical disconnect device such as a circuit breaker or a pullout switch. The disconnect device has a housing which defines a cavity that faces in one direction for receiving a cable. Front and rear contacts are in the housing, one of which extends into the cavity for engagement with a cable. A terminal reversing block has a housing with at least one pocket which faces in a direction other than the opposite of the direction in which the disconnect device's cavity faces. A terminal collar disposed in the terminal reversing block pocket is engageable with a cable inserted into the pocket. A terminal in the reversing block has a mating portion and a connecting portion. The connecting portion engages the terminal collar. The mating portion engages one of the front and rear contacts of the electrical disconnect device. The arrangement of the directions in which the cavity and pocket face permits routing of the cables to minimize space requirements in a confined area, such as an enclosure or a cabinet.

20 Claims, 19 Drawing Sheets

TERMINAL REVERSING BLOCK

CROSS REFERENCE TO RELATED APPLICATION

This application claims the benefit of U.S. Provisional Application Ser. No. 61/288,805, filed Dec. 21, 2009, the disclosure of which is incorporated by reference herein.

BACKGROUND OF THE INVENTION

The present invention relates to adapters for rerouting electrical wires or cables. In particular, the present invention relates to terminal reversing blocks for changing the direction of electrical cables extending out of an electrical disconnect device. As used herein the term "cable" will be used to describe electrical conductors including wires, cables, busbars or other conductors.

High current electrical disconnect devices, such as pull-out switches or circuit breakers for example, are typically connected to thick, heavy electrical cables. The cable connectors of such disconnect devices are commonly referred to as terminal collars. The terminal collars conventionally are located on opposite sides of the housing of the disconnect device. This arrangement arises from the fact that the disconnect device internally has a selectably bridgeable gap in its conductors so there are two naturally-defined, physically separate "sides" of the conductive path through the disconnect. Thus, it is most convenient to physically locate the cable connectors that terminate the two sides of the electrical path on separate sides of the disconnect device. This choice is reinforced by the space requirements of the large cables. It is convenient to route the incoming and outgoing cables on opposite sides of the disconnect device to keep them out of each other's way.

The electrical disconnect device is typically mounted inside an enclosure, such as a junction box or a cabinet. Heavy electrical input cables bring power into the electrical disconnect device and similarly large electrical output cables carry power out of the electrical disconnect device. The diameter of the electrical input and output cables is such that the cables do not bend easily. Consequently, if a linear, single-direction arrangement of the cables is unworkable in a particular situation large spaces are required to bend an electrical input or output cable around to effect a variation in a cable's direction.

As mentioned above, high current electrical disconnect devices have cable retaining structures such as terminal collars which include lugs with clamping screws. For example, the disconnect device can be a pullout fusible switch that is configured to have electrical input cables enter into the bottom of the switch and electrical output cables exit out of the top of the switch, as seen in U.S. Pat. No. 4,536,046 to Erickson, the disclosure of which is incorporated herein by reference. Another example of an electrical disconnect device is a load switch or circuit breaker, as seen in U.S. Pat. No. 4,363,063 to Erickson, the disclosure of which is incorporated herein by reference.

It is often desired to have the electrical input and output cables routed in directions other than the conventional opposite directions. For example, it is sometimes advantageous to have the output cables routed in the same direction as the input cables. That is, the input and output cables are essentially right next to each other. This may be due to limitations on space in the enclosure that contains the electrical disconnect device. The current method to accomplish this is to bend the electrical output cables around in an arc to route the output cables in the same direction as the input cables. Due to the large diameter of high power cables, the radius about which they will bend is large. This means the space required to bend the cables in a reversing arc may be larger than is available. In addition, the extra lengths of cables or cables required to make such an arc increases the cost.

This problem is illustrated in FIG. 21. A standard electrical disconnect device 2 (in this case a load switch or circuit breaker) has input cables 4 attached to the bottom side thereof and output cables 6 extending from the top side of the disconnect device 2. A wide enclosure 8 is needed to bend output cables 6 around to be routed out the same side of the enclosure 8 from which input cables 4 enter the enclosure 8. This Figure is merely illustrative of the problem, as in some situations even the somewhat large radius of curvature shown may not be achievable due to the stiffness of the output cables.

Thus, there remains a need for a way to reroute electrical output cables from an electrical disconnect device in a minimum of space. There also remains a need for a way to adapt such electrical cable routing to industry standard electrical disconnect devices, such as pull out switches or circuit breakers for example.

SUMMARY OF THE INVENTION

The present invention provides a terminal reversing block that connects to a standard electrical disconnect device. The terminal reversing block has a dielectric housing that mounts therein one or more conductive terminals. Each terminal has a mating portion, a body portion, and a connecting portion. The mating portion is engageable with a conductor of the electrical disconnect device. The connecting portion is engageable with an output cable by means of a terminal collar. The body portion joins the mating and connecting portions. The connecting portion of the terminal is located remotely from the mating portion.

The terminal reversing block's housing can be sized and shaped to fit above or below the electrical disconnect device. The terminal reversing block is preferably sized and shaped to have the same or roughly the same length and width as the electrical disconnect device, thereby minimizing the length and width required for the completed assembly of the terminal reversing block and electrical disconnect device. The body portion of the terminal may include an offset section that separates the longitudinal axes of the mating portion and connecting portions thereby providing easy access to the terminal collars on the electrical disconnect device and the terminal reversing block. Alternatively, the terminal reversing block can be sized and shaped to extend out from at least one side of the electrical disconnect device so as not to increase the height of the electrical disconnect device, thereby minimizing the height required for the enclosure of the terminal reversing block and electrical disconnect device.

These and other desired benefits of the invention, including combinations of features thereof, will become apparent from the following description. It will be understood, however, that a device could still appropriate the claimed invention without accomplishing each and every one of these desired benefits, including those gleaned from the following description. The appended claims, not these desired benefits, define the subject matter of the invention.

DETAILED DESCRIPTION OF THE INVENTION

Figure 1:
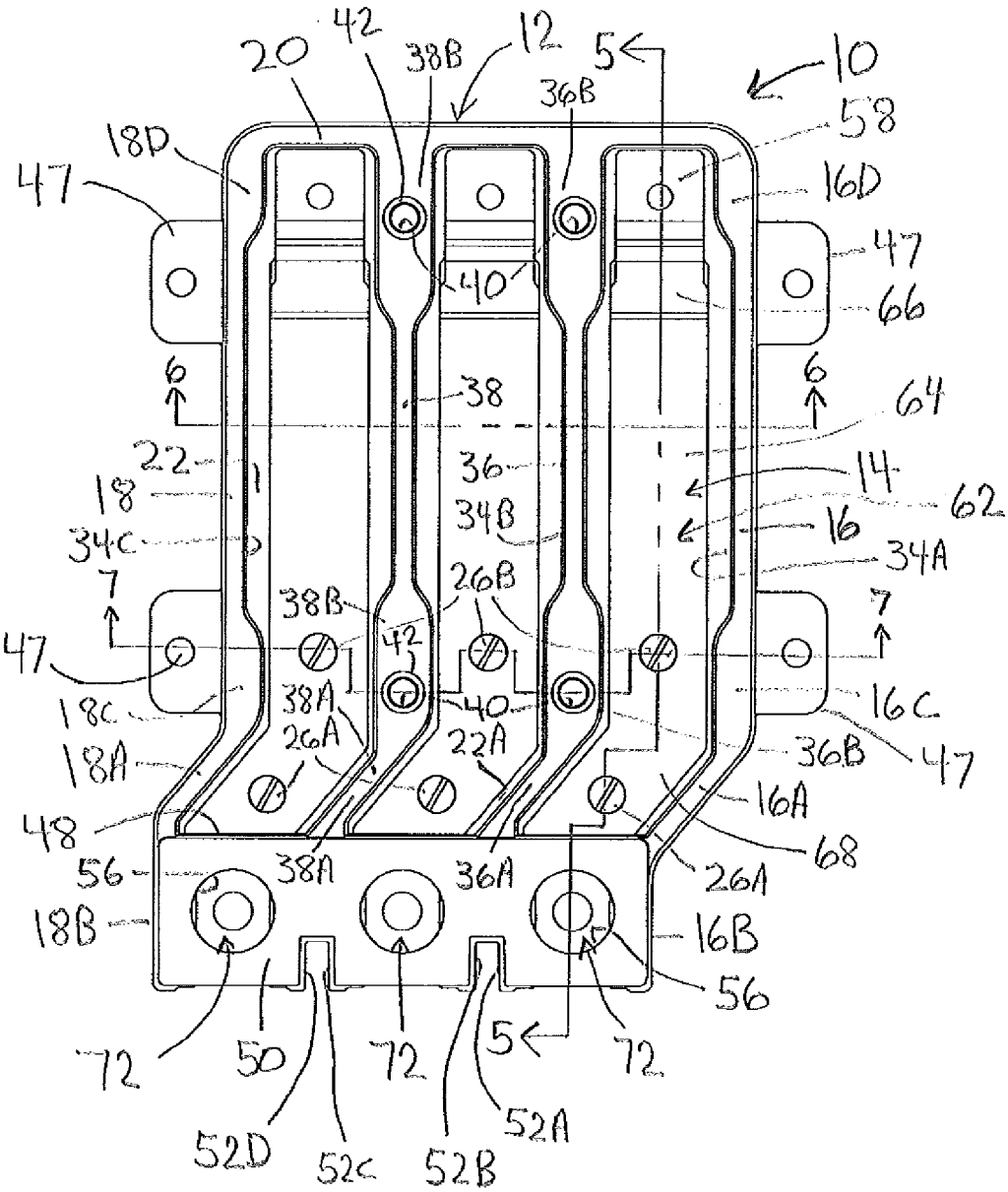
FIG. 1 is a top plan view of a terminal reversing block in accordance with the present invention.

A terminal reversing block 10 in accordance with the present invention is shown in FIG. 1. Terminal reversing block 10 is adapted for heavy duty power transmission applications. For example and not by way of limitation, the illustrated terminal reversing block 10 is rated at 240 volts AC/125 volts DC and 400 amps. Terminal reversing block includes three main components, a housing or base 12, one or more terminals or blades 14, and a terminal collar 72 associated with each terminal. For clarity in illustrating the housing 12 and terminals 14, the terminal collars 72 are not shown in FIGS. 2-7. The terminal collars are shown and described below in connection with FIGS. 11 and 14. Also, references herein to front, side, top, bottom and the like are from the point of view of a terminal reversing block mounted on a horizontal surface. Obviously the terminal reversing block could be mounted on a vertical surface such as a wall or a rack. Accordingly, directional references to the block's front, side, top or bottom are for reference purposes only and are not to be interpreted as limiting the orientations in which the terminal reversing block could be mounted.

In this embodiment the terminal reversing block is a three-pole device. Accordingly, it has three terminals 14. It will be understood that different numbers of poles and terminals therefor could be provided depending on the needs of a particular application. Housing 12 and terminal 14 can be made from any industry standard dielectric and conductive materials, respectively. By way of example only, housing 12 may be molded of an insulator resin, usually a phenolic resin, and the terminals 14 are made of copper with a finish of silver plate and protective dip.

Figure 7:
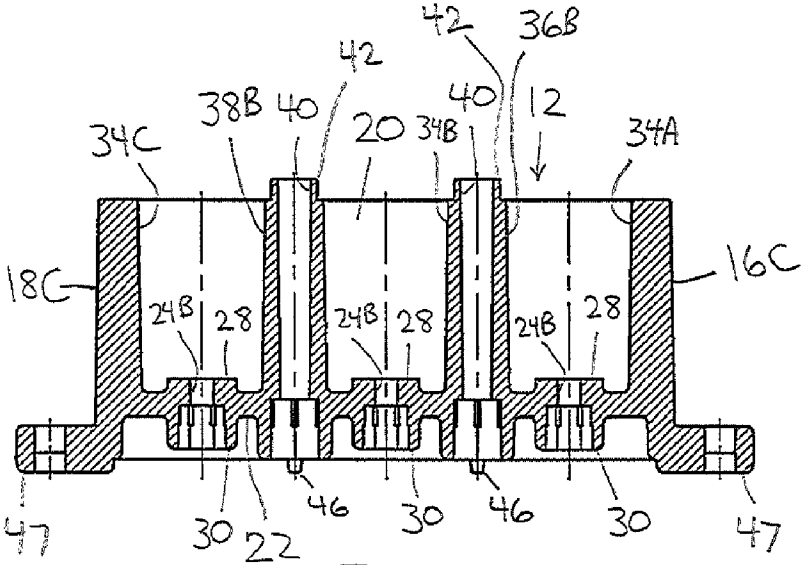
FIG. 7 is a section, on an enlarged scale, of the terminal reversing block housing, taken generally along line 7-7 of FIG. 1.

Details of the housing's construction are illustrated in FIGS. 1 through 7. The housing 12 has two sections, a terminal-receiving shell and a collar-receiving case. The shell has two side walls 16, 18 joined by a transverse end wall 20. The side walls 16, 18 each have an angled portion 16A, 18A, respectively. Front extensions 16B, 18B join the angled portions. At the junction of the angled portions with the straight main portions of the side walls the wall thickness is somewhat enlarged at 16C, 18C (FIGS. 1 and 7). Similar enlargements are found at 16D, 18D where the side walls join the end wall 20. The top lands of these enlargements serve as resting surfaces for the feet of an electrical disconnect device mounted on top of the shell.

Figure 2:
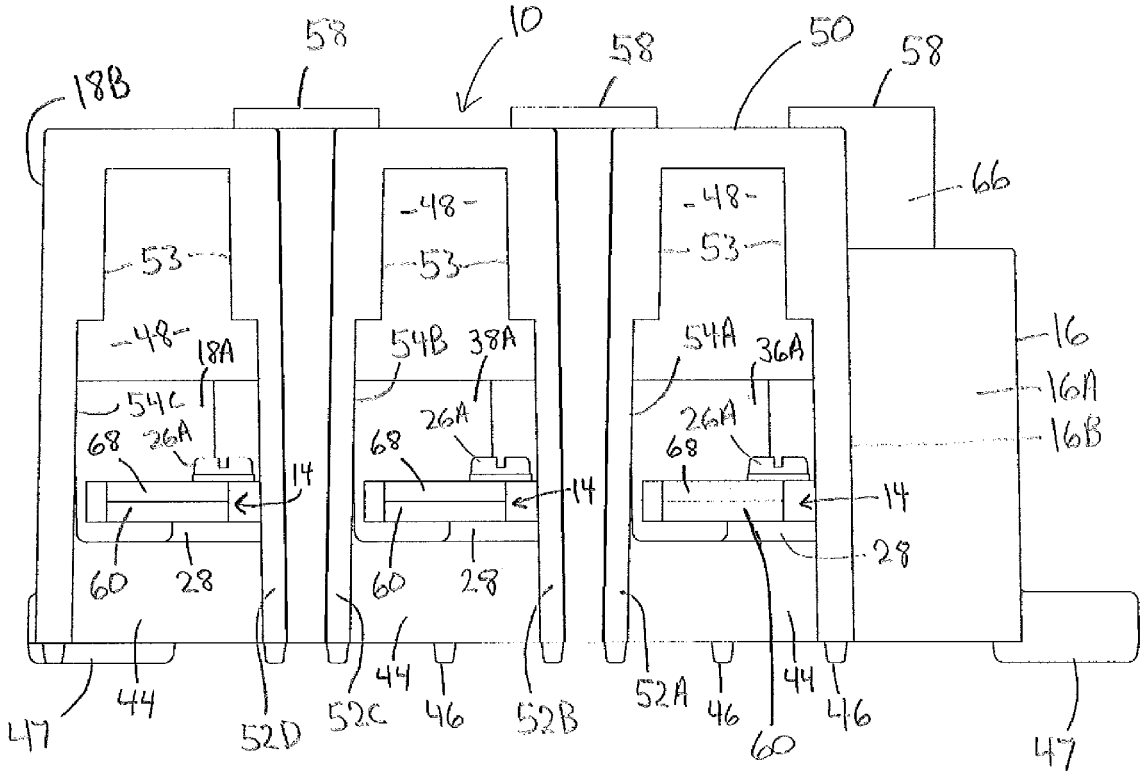
FIG. 2 is a front elevation view, on an enlarged scale, of the terminal reversing block.
Figure 3:
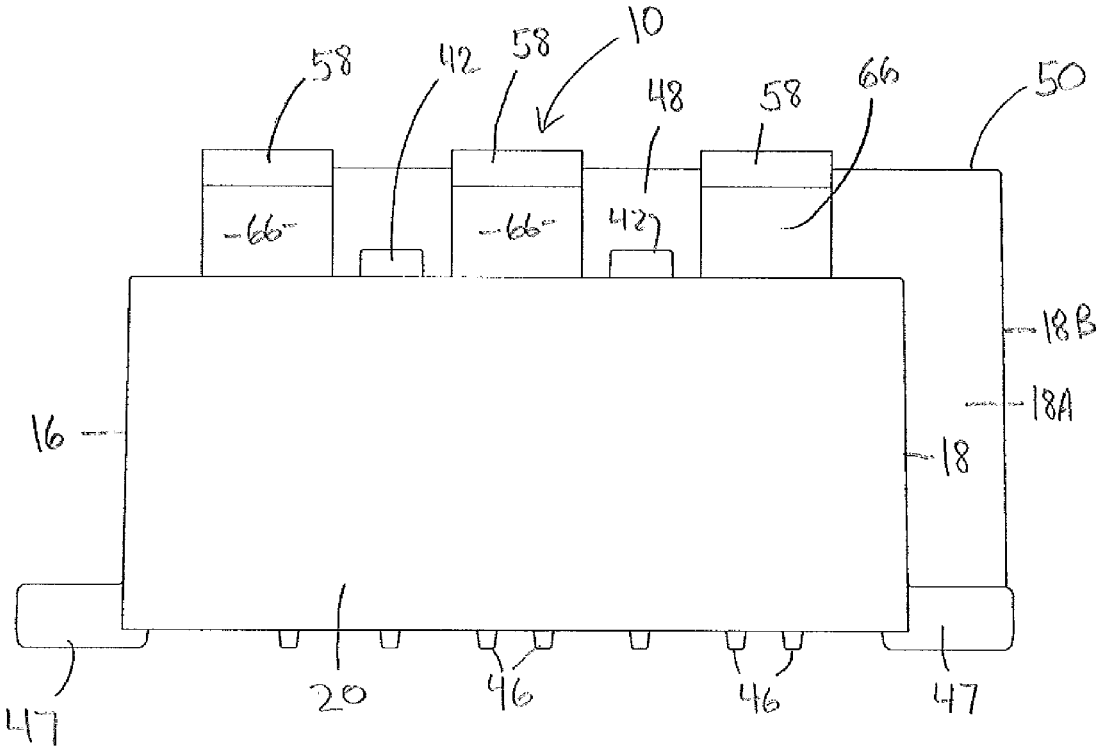
FIG. 3 is a rear elevation view, on an enlarged scale, of the terminal reversing block.
Figure 4:
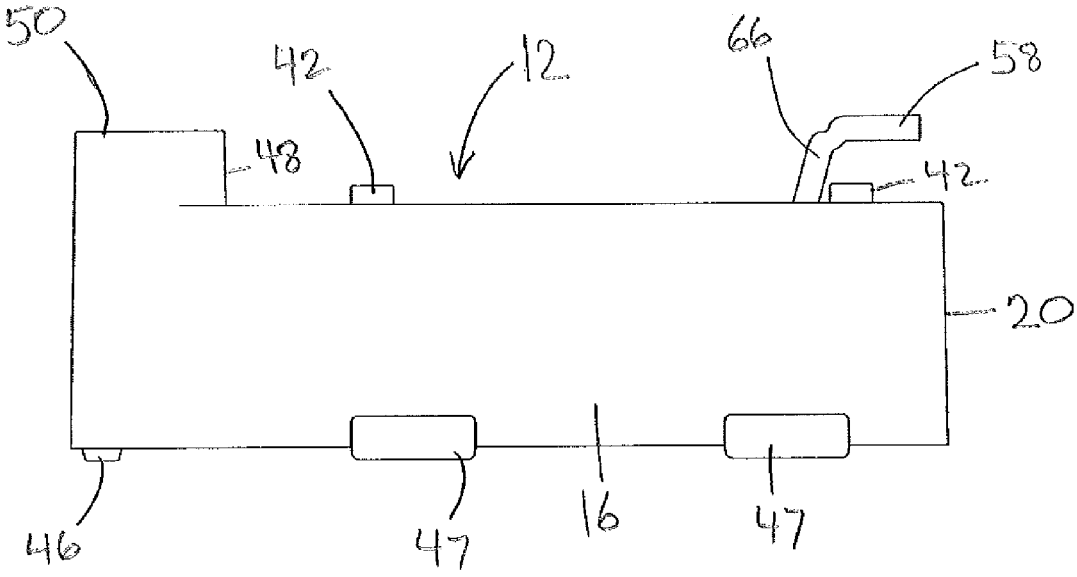
FIG. 4 is a side elevation view of the terminal reversing block.
Figure 5:
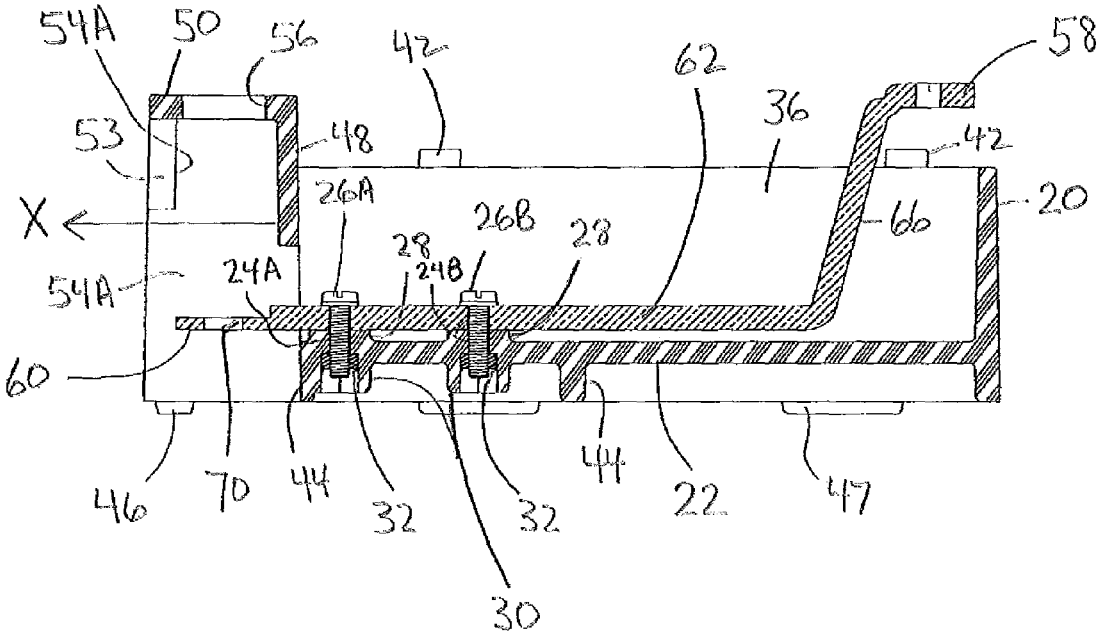
FIG. 5 is a section of the terminal reversing block, taken generally along line 5-5 of FIG. 1.
Figure 6:
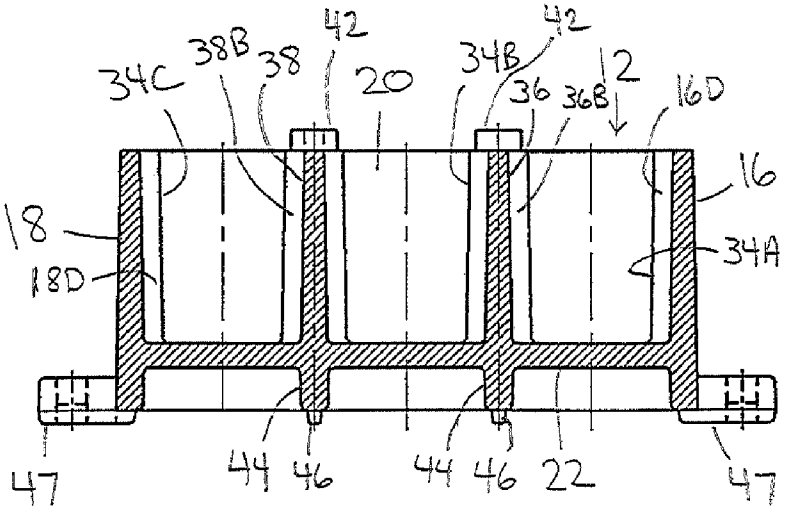
FIG. 6 is a section, on an enlarged scale, of the terminal reversing block housing, taken generally along line 6-6 of FIG. 1.

The housing's shell section further includes a bed or floor 22 which extends between the side walls 16, 18 and end wall 20. To accommodate the angled portions 16A, 18A of the side walls the floor 22 has an angled front portion 22A. The floor is located somewhat above the bottom edges of the side and end walls, as seen in FIGS. 5-7. Those figures best illustrate that the floor has six terminal-mounting bores through it. Three of these bores 24A (FIG. 5) are in the angled front portion 22A of the floor. Three more of the bores 24B (FIGS. 5 and 7) are aligned with the enlargements 16C, 18C of the side walls. Although the bores themselves are covered in FIG. 1 it can be understood that bores 24A are aligned with and receive the terminal-mounting bolts 26A and bores 24B are aligned with and receive terminal-mounting bolts 26B. Each bore 24A, 24B is surrounded on the top surface of the floor by an upper boss 28. The upper bosses engage the underside of a terminal 14, as seen in FIGS. 2 and 5, to create an air gap between the terminal and the floor, which aids in heat dissipation. Each bore 24A, 24B is also surrounded on the bottom surface of the floor by a lower boss 30. The lower boss receives a nut 32 (FIG. 5) which is engageable with one of the terminal mounting bolts 26A or 26B.

In this three-pole embodiment the shell is subdivided into three terminal-receiving chambers 34A, 34B, 34C by two partitions 36, 38. The partitions extend generally parallel to the side walls 16, 18. Thus, the partitions also include angled portions 36A, 38A. Each partition 36, 38 also has a pair of enlarged or thickened portions 36B, 38B, respectively. The enlarged portions each accommodate a threaded bore 40 therein. The threaded bores receive mounting screws (not shown) which extend through an electrical disconnect device to retain the device on the shell. Cylindrical protrusions 42 surround the bores 40 and extend a short distance above the top land of the partitions 36, 38. These protrusions fit into small depressions (not shown) in the underside of an electrical disconnect device mounted on the shell to serve as locators for the disconnect device.

The shell portion of the housing 12 has a series of ribs 44 on the underside of the floor 22, some of which are seen in FIGS. 2 and 5-7. Some of the ribs carry small feet 46, which lift most of the housing off a surface to which it is mounted to facilitate air flow around the underside of the housing. The shell is completed by four mounting tabs 47 which extend from the bottom edges of the side walls 16, 18. The tabs have holes therein for receiving a mounting screw (not shown). It will be noted that the bottom surfaces of the mounting tabs are coplanar with the bottom edges of the feet 46.

Attention is now directed to the case section of the housing. The case section is a box-like portion attached to the front of the shell section. In fact, the extensions 16B, 18B of the side walls define the sides of the case. The case further includes a transverse rear wall 48 and a top wall 50. Depending from the top wall 50 and attached at the rear wall 48 are four vertical interior walls 52A, 52B, 52C and 52D. At the front edge of the interior walls and adjoining the underside of the top walls is a retention ledge 53 (FIGS. 2 and 5). A similar retention ledge 53 is formed on the inner surfaces of the side wall extensions 16B, 18B. Together the extensions 16B, 18B, rear wall 48, top wall 50, interior walls 52A-D and retention ledges 53 define three collar-receiving pockets 54A, 54B, 54C, as best seen in FIG. 2. These pockets are open to the bottom and are largely open to the front except for the retention ledges 53. Access to each pocket through the top wall 50 is provided by openings 56 in the top wall. The collar-receiving pockets are sized to receive one terminal collar in each pocket, as will be explained below. The pockets can be considered to face in a direction generally perpendicular to the rear wall 48 and toward the open front of the pocket. Thus, for example, the pocket 54A in FIG. 5 faces in the direction of arrow X.

Figure 9:
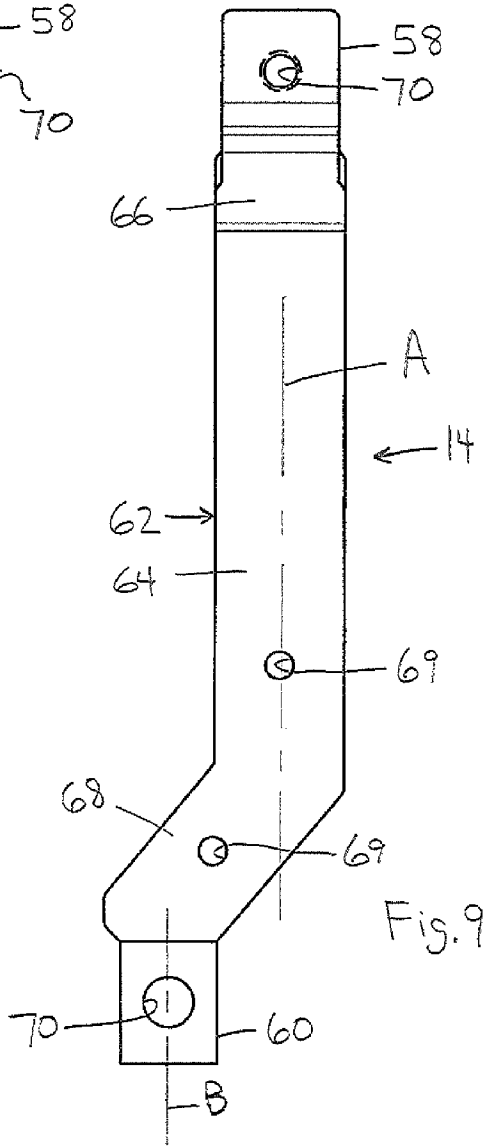
FIG. 9 is a top plan view of a terminal.
Figure 8:
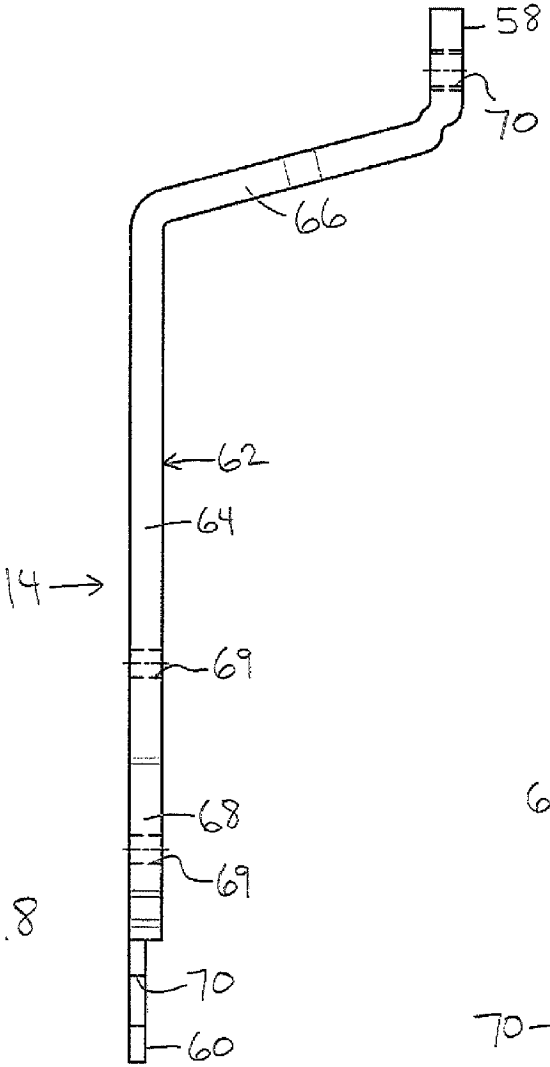
FIG. 8 is a side elevation view of a terminal.
Figure 10:
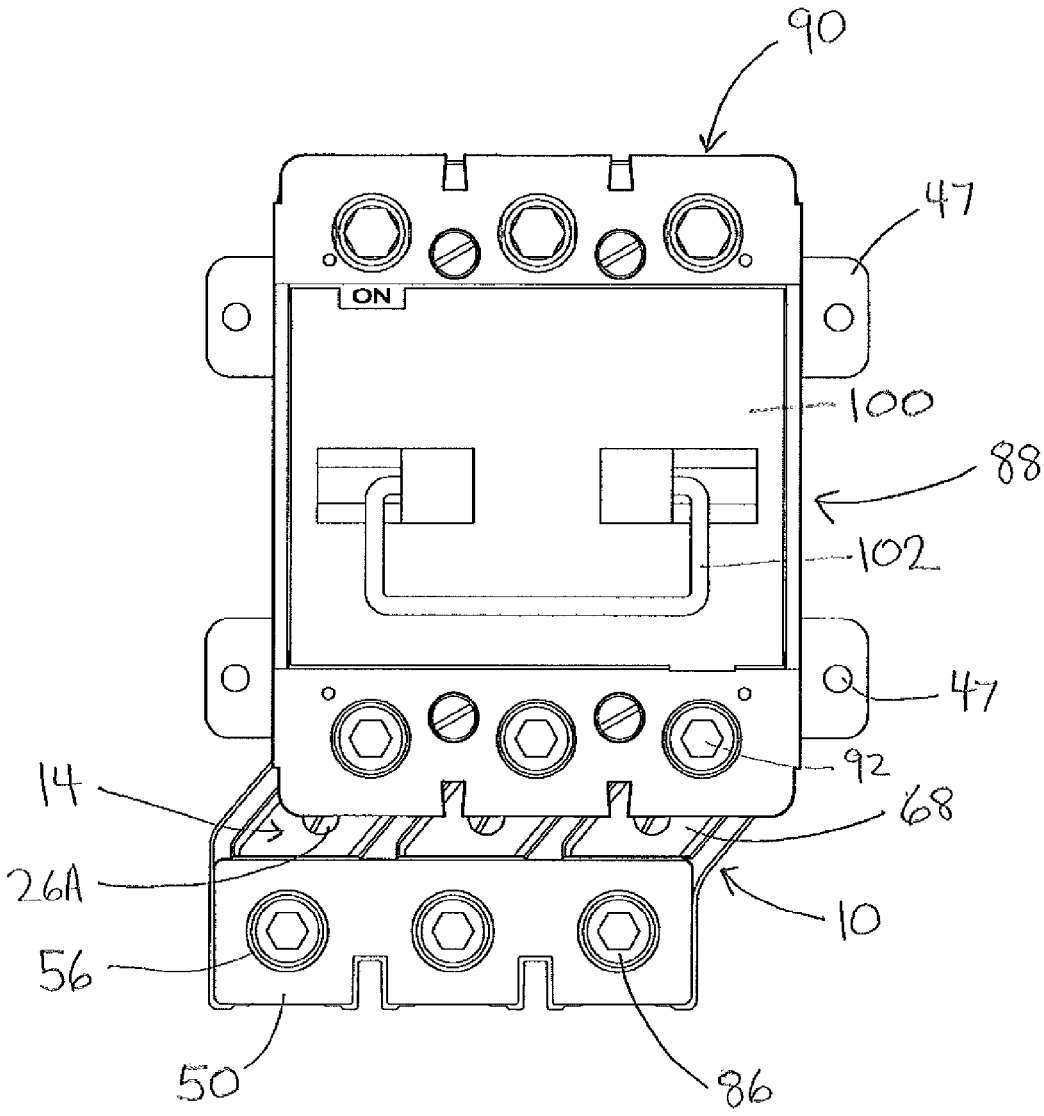
FIG. 10 is a top plan view of an electrical disconnect device, in this instance a pullout switch, assembled on the terminal reversing block of the present invention.

FIGS. 8 and 9 illustrate details of the terminal or blade 14. Each terminal is an integral part that has a mating portion 58, a connecting portion 60 and a body portion 62. In this embodiment the body portion includes a planar, straight trunk 64, an upstanding neck 66 extending out of the plane of the trunk, and an offset portion 68. The mating portion 58 adjoins the neck 66 while the connecting portion 60 adjoins the offset portion 68. Both the trunk 64 and offset portion 68 have mounting apertures 69 therethrough for receiving the terminal mounting bolts 26A, 26B. There is also a bore 70 in the mating portion 58 and connecting portion 60. It will be noted that the trunk 64 defines a longitudinal main axis A and connecting portion 60 defines a longitudinal offset axis B. Due to the presence of the offset portion 68 of the terminal, the main axis A and offset axis B are spaced from one another.

Figure 11:
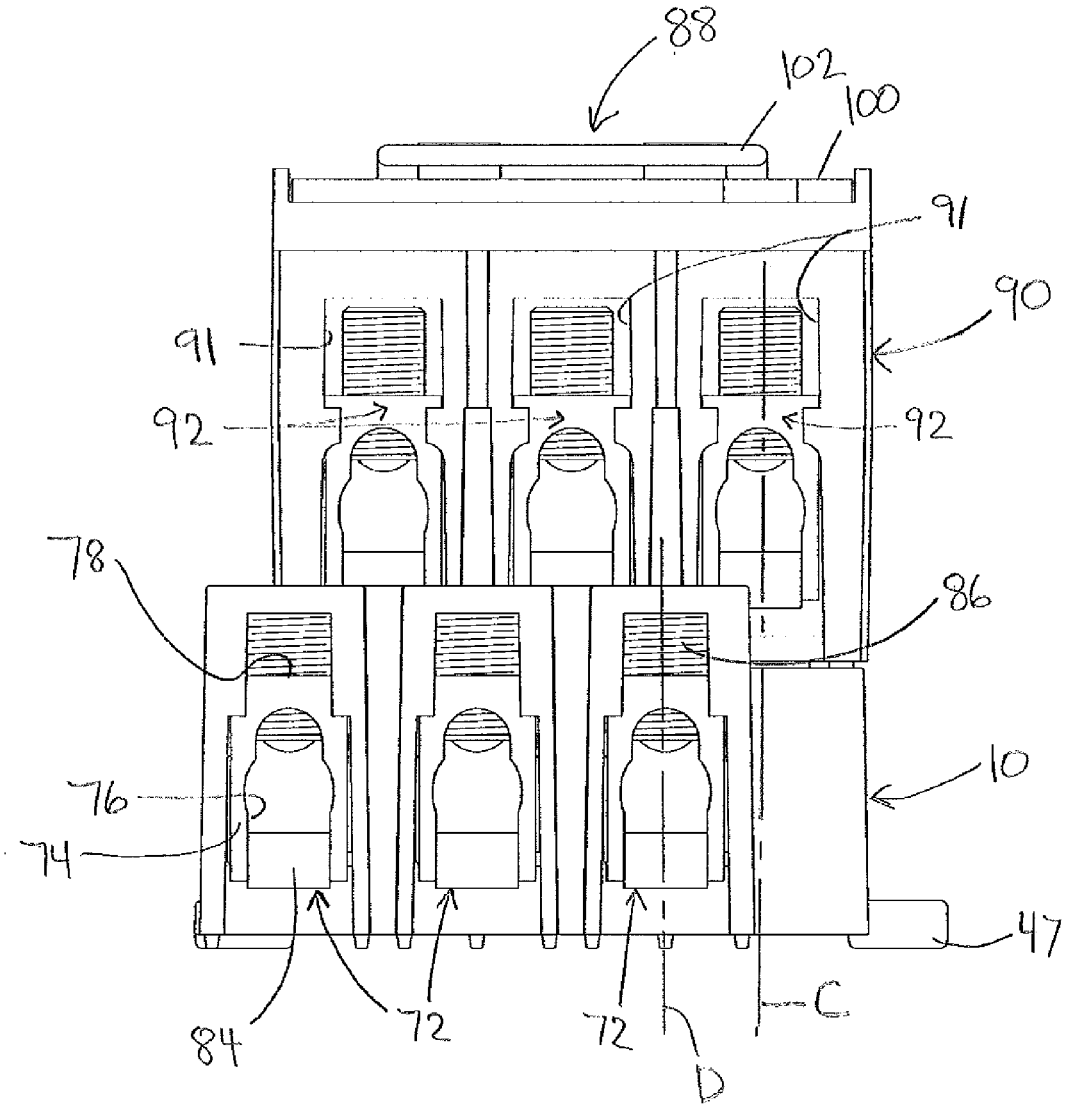
FIG. 11 is a front elevation view of the assembly of FIG. 10.
Figure 12:
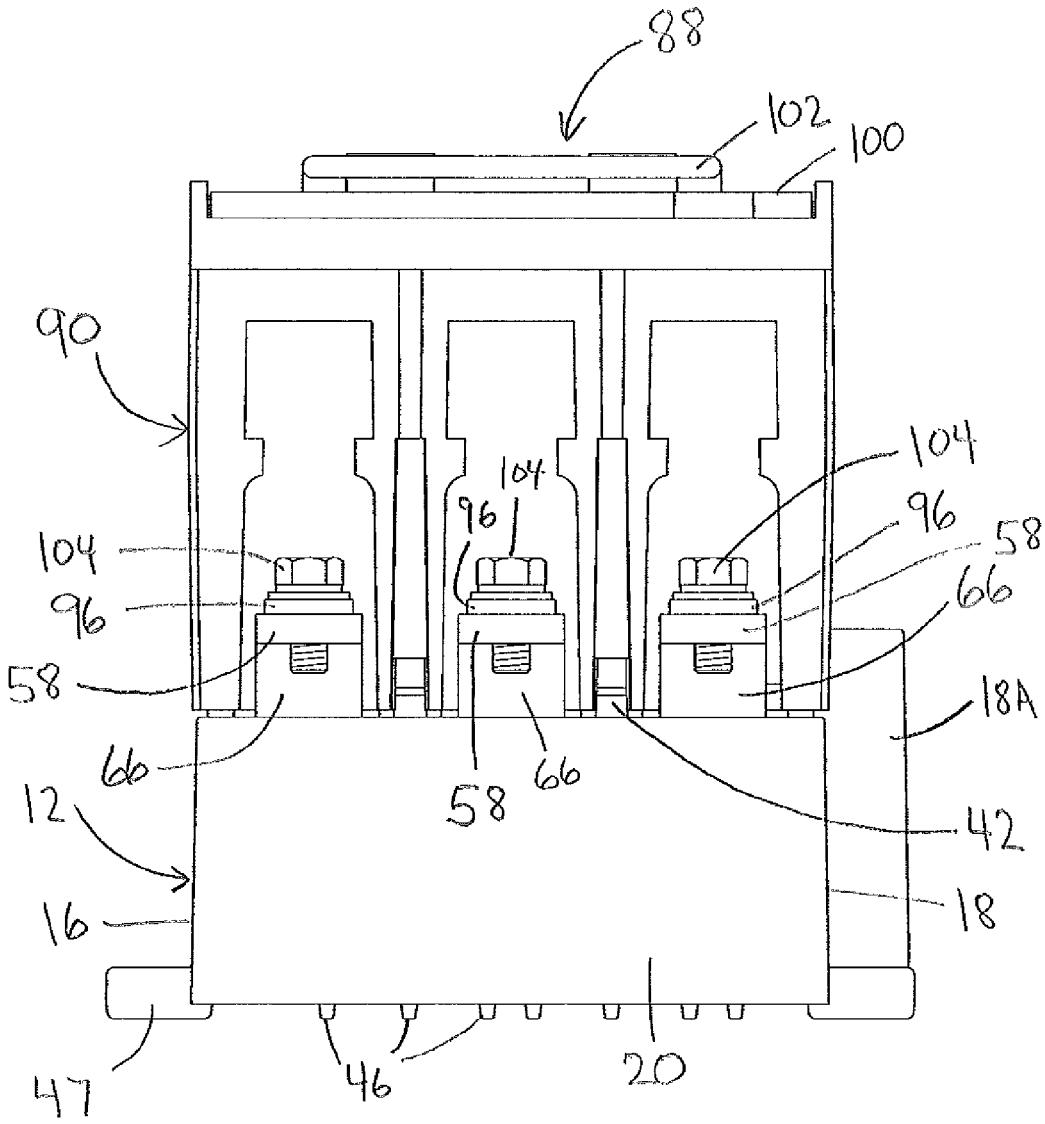
FIG. 12 is a rear elevation view of the assembly of FIG. 10.
Figure 13:
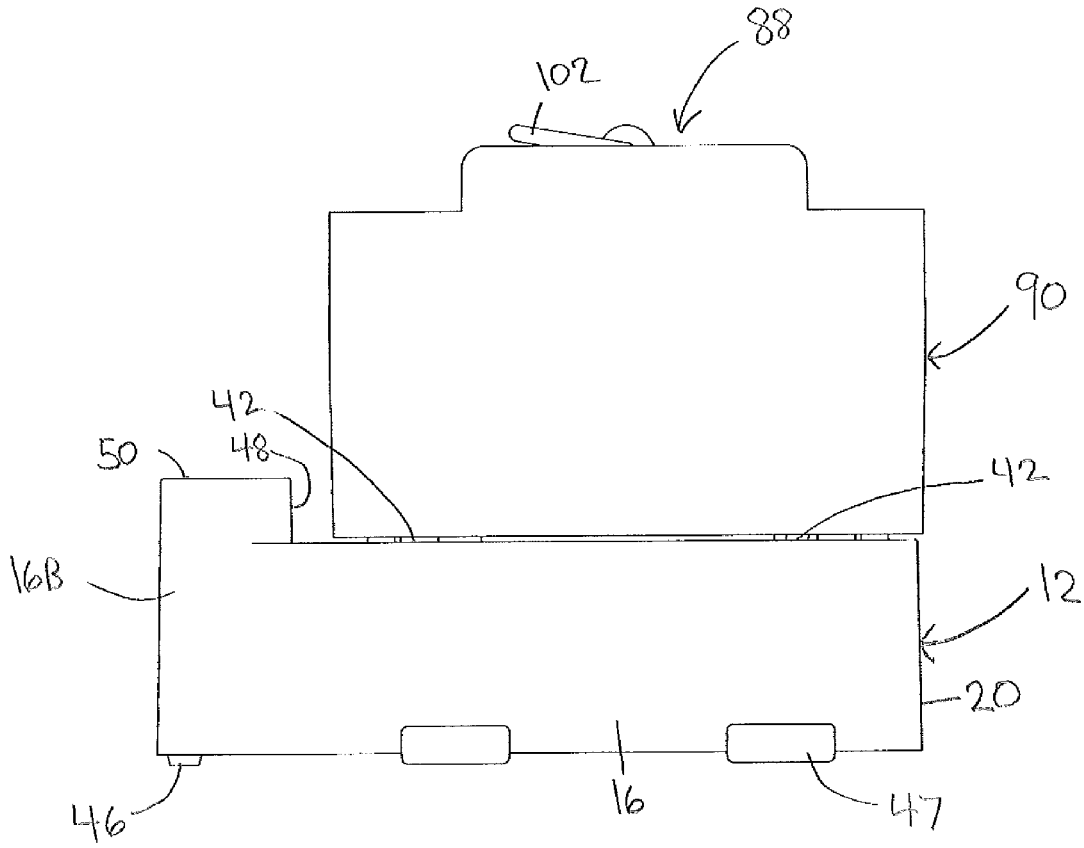
FIG. 13 is a side elevation view of the assembly of FIG. 10.
Figure 14:
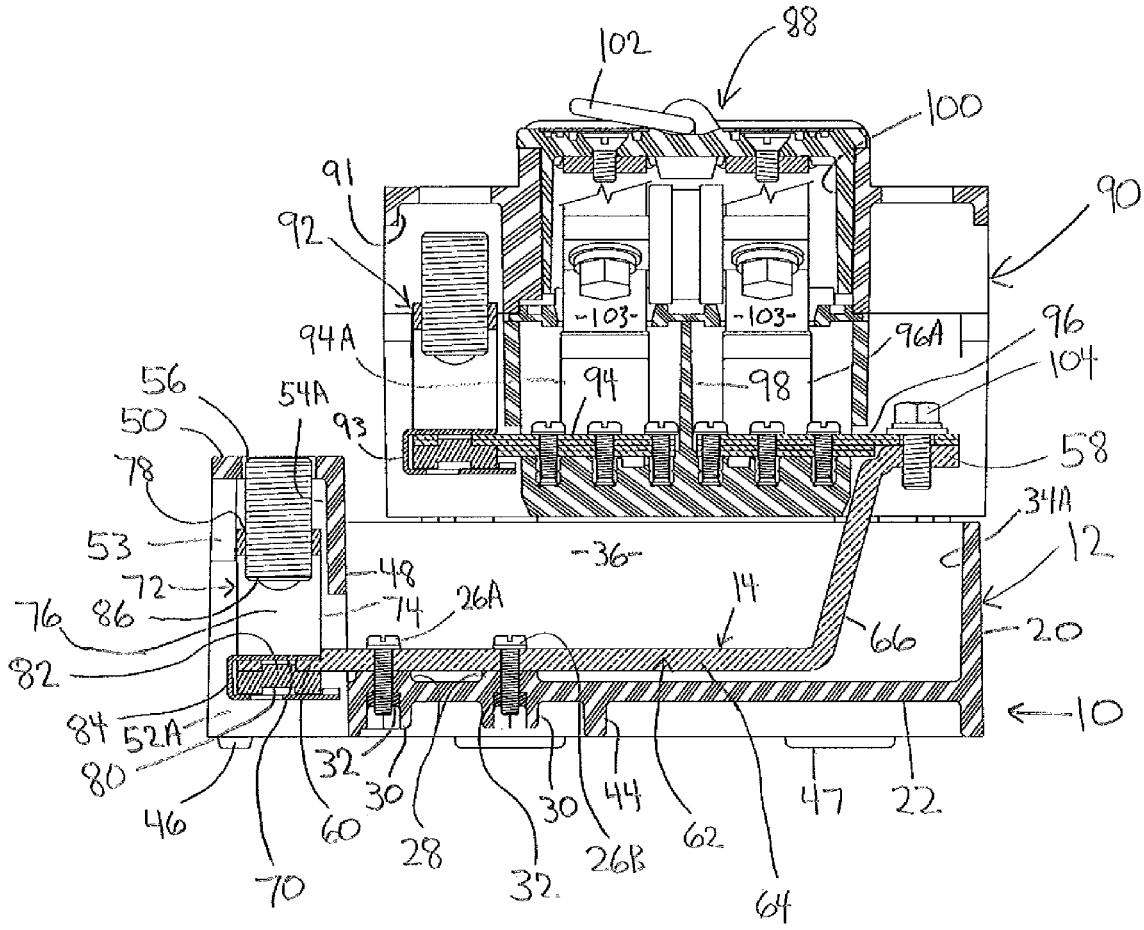
FIG. 14 is a section, similar to FIG. 5, of the assembly of FIG. 10.

FIGS. 11 and 14 show the terminal collar generally at 72. In the illustrated three-pole disconnect device and terminal reversing block, there are three terminals 14 in the reversing block, one in each terminal-receiving chamber 34. These terminals are each connected to one of the three terminal collars in the disconnect device, one collar in each of the collar-receiving pockets 54A, 54B, 54C. Only one of the terminal collars will be described since the others have the same construction. The terminal collar is made of a conductive material such as a suitable aluminum alloy. It includes a main body or lug 74. The lug is a generally rectangular block with a central passage 76 through it that defines a roof 78 and a floor 80 in the lug 74. The floor's upper surface has a small protrusion 82. A C-shaped clip 84 is engageable with the floor as will be explained. The roof 78 has a threaded aperture through it that receives a threaded clamping screw 86. The clamping screw can be threadedly advanced into and retracted from the central passage 76 to selectably retain or release a cable.

Assembly of the terminal reversing block is as follows. First, a terminal 14 is placed in each of the housing's terminal-receiving chambers 34A-C with the terminal's mounting apertures 69 aligned with the bores 24A, 24B in the housing floor 22. Then the terminal mounting bolts 26A, 26B are installed to fix the terminal in place. It will be evident that the terminal's offset portion 68 lies above the angled portion 22A of the floor and the terminal's connecting portion 60 extends into the one of the collar-receiving pockets MA-C. Next the terminal collars 72 are placed in the pockets MA-C. With the C-shaped clip removed, the lug 74 is inserted into the pocket from the front but with the roof 78 lower than its ultimate position so the roof will clear the lower edges of the retention ledges 53. At this point the connecting portion 60 of the terminal will extend into the central passage 76 of the lug but somewhat above the floor 80. Once the lug is far enough into the pocket to clear the retention ledges 53, the lug is pushed upwardly so it fits in behind the retention ledges. This upward movement of the lug carries the foot's protrusion 82 into engagement with the bore 70 in the terminal's connecting portion 60 and places the connecting portion in engagement with the top surface of the floor 80. Then the C-shaped clip 84 is placed over the connecting portion 60 and bottom of the floor 80. The C-shaped clip has sufficient spring force to retain it in place on the lug's floor. The clip 84 holds the terminal collar 72 on the terminal's connecting portion 60 and prevents the terminal collar 72 from falling out the bottom of the pocket 54. It can be seen that once a cable is placed in the central passage, a driver tool, e.g., a hex driver, can be placed through one of top wall openings 56 to engage the clamping screw 86 and advance it into the central passage, thereby clamping the cable between the screw and the top surface of the C-shaped clip 84.

Having described the terminal reversing block 10, we can now turn to the electrical disconnect device. One embodiment of an electrical disconnect device 88 is shown installed on a terminal reversing block 10 in FIGS. 10-14 In this example the device 88 is a standard pullout switch. One of the advantages of the present invention is that no alteration in the construction of the pullout switch is required. It may be advantageous to remove the terminal collars on the output side of the disconnect device but this is not absolutely necessary. The pullout switch 88 is mounted on the shell of the terminal reversing block and held by screws (not shown) that extend through the switch and into bores 40.

The pullout switch 88 has a housing 90 that has front and rear case sections similar to that of the terminal reversing block. The front case section has three cavities 91 which are generally similar to the pockets 54 in the terminal reversing block. Terminal collars 92 similar to collars 72 are disposed in the cavities 91 (the rear case section is shown with its collars removed). C-shaped clips 93 (FIG. 14) connect the collars 92 to front contacts 94, which are mounted on the floor of the housing 90. Rear contacts 96 are also mounted on the floor. As can be seen in FIG. 14 the front and rear contacts 94, 96 in this embodiment are laminated plates fastened to the housing 90 by bolts. Each contact includes an upstanding member 94A, 96A, as seen in FIG. 14. A dividing wall 98 mechanically and electrically separates the front and rear contacts. A removable insert section 100 fits into a well formed in the center of the housing 90. The insert section has a handle 102 by which it can be lifted out of the housing. It will be understood that the interior of the insert section includes bridging members 103, i.e., electrical conductors that will engage the upstanding members 94A, 96A of the front and rear contacts when the insert section is installed in housing 90, thereby providing a conductive path between the contacts.

As seen in FIG. 14, the neck 66 of the terminal 14 extends into the rear case section of the housing 90, placing the terminal mating portion 58 adjacent the end of the rear contact 96. A connecting bolt 104 is threaded into the threaded bore 70 to bond the mating portion 58 tightly to the rear contact 96.

Figure 15:
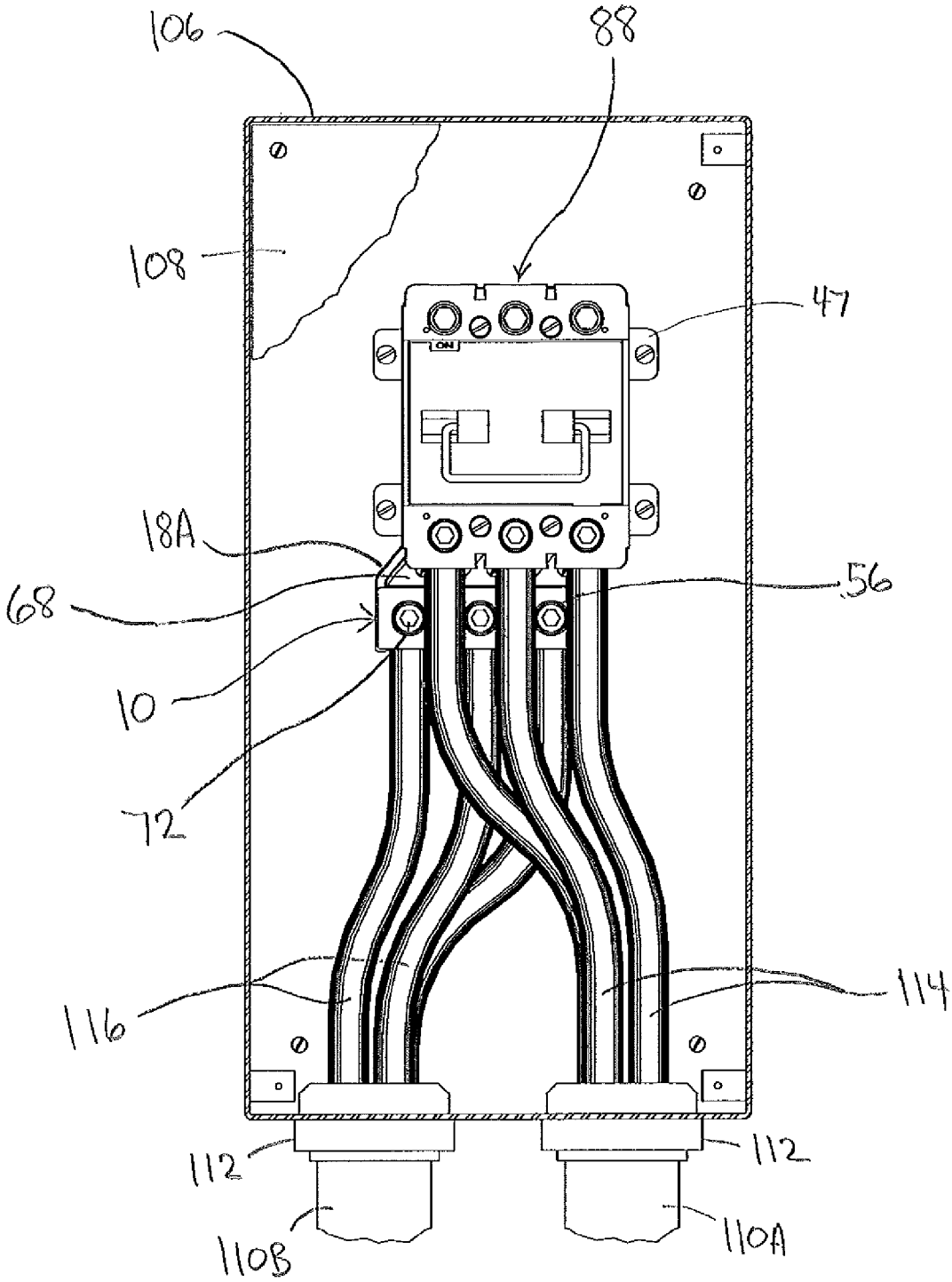
FIG. 15 is a top plan view of an electrical disconnect device, in this instance a pullout switch, assembled on a terminal reversing block, mounted in an enclosure and with cables connected to the electrical disconnect device and terminal reversing block.
Figure 16:
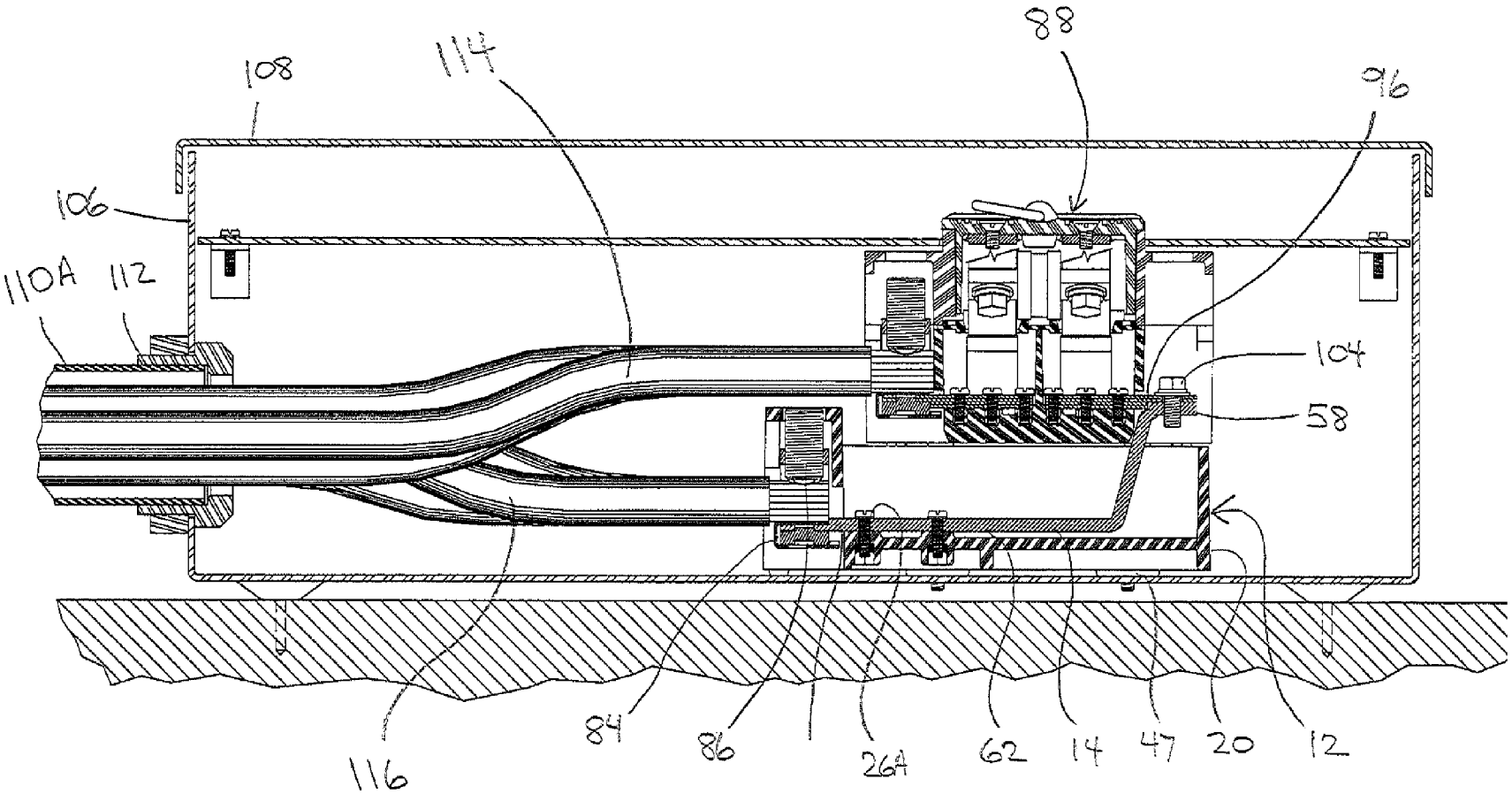
FIG. 16 is a cross sectional side elevation view of the electrical disconnect device assembly of FIG. 15.

FIGS. 15 and 16 illustrate the assembly of an electrical disconnect device 88 and a terminal reversing block 10 mounted in an enclosure 106. The enclosure could be any sort of cabinet, load center or the like for protecting the equipment therein. The cabinet may have a door or cover 108. Conduits 110A, B may join the enclosure through suitable junctions 112. Input cables 114 installed in conduit 110A enter the bottom of the cabinet and are connected to the disconnect device 88 at its terminal collars 92. Output cables 116 installed in conduit 110B are connected to the terminal reversing block 10 in the manner described above. As FIGS. 15 and 16 show, both the input and output cables extend through the bottom of the enclosure, in a compact space because the terminal reversing block reverses the direction of the output terminal collars.

Figure 17:
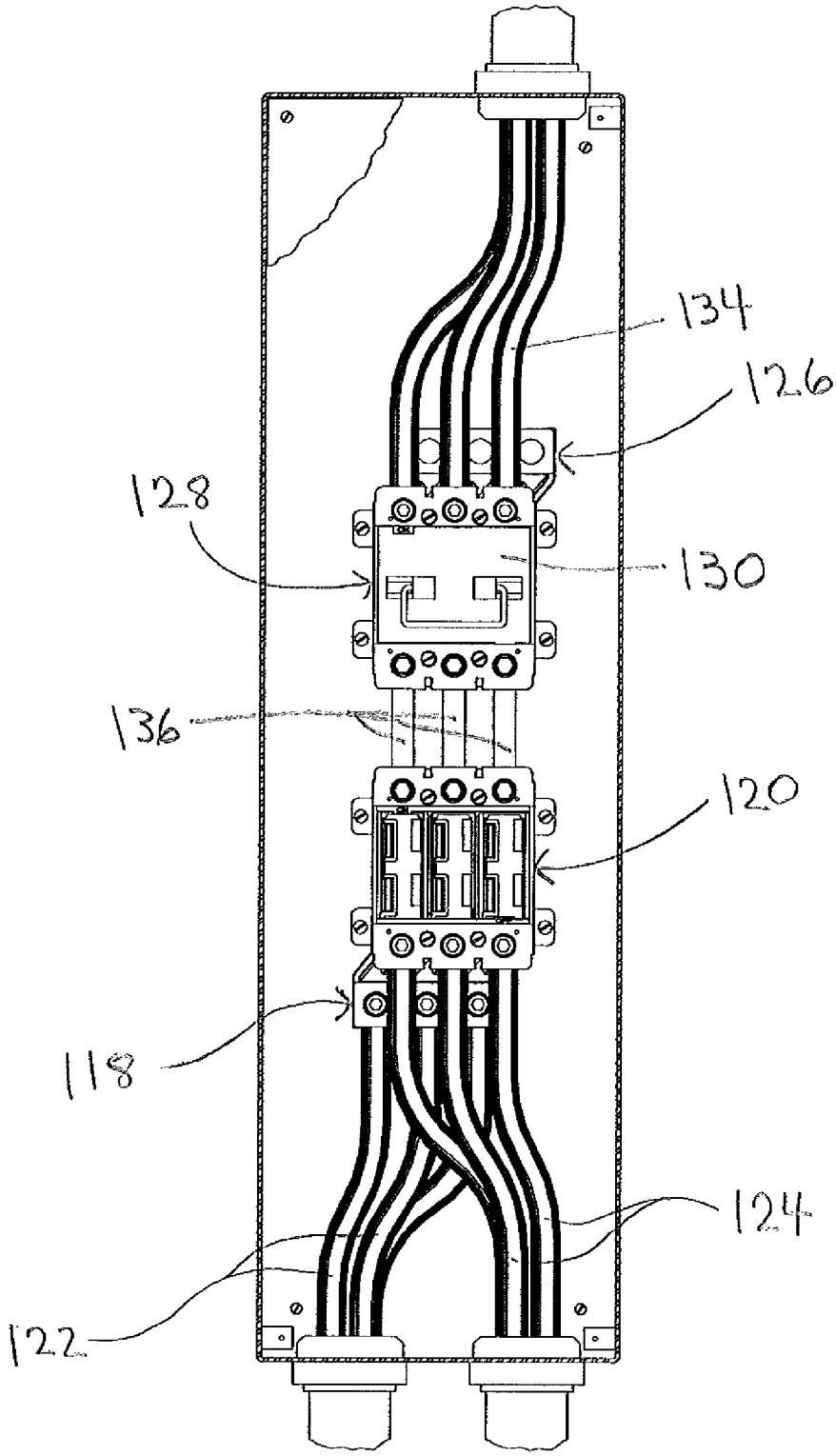
FIG. 17 is a top plan view of two electrical disconnect devices mounted on alternate embodiments of reversing blocks, illustrating a configuration of dual reversing blocks to create a manual transfer switch.
Figure 18:
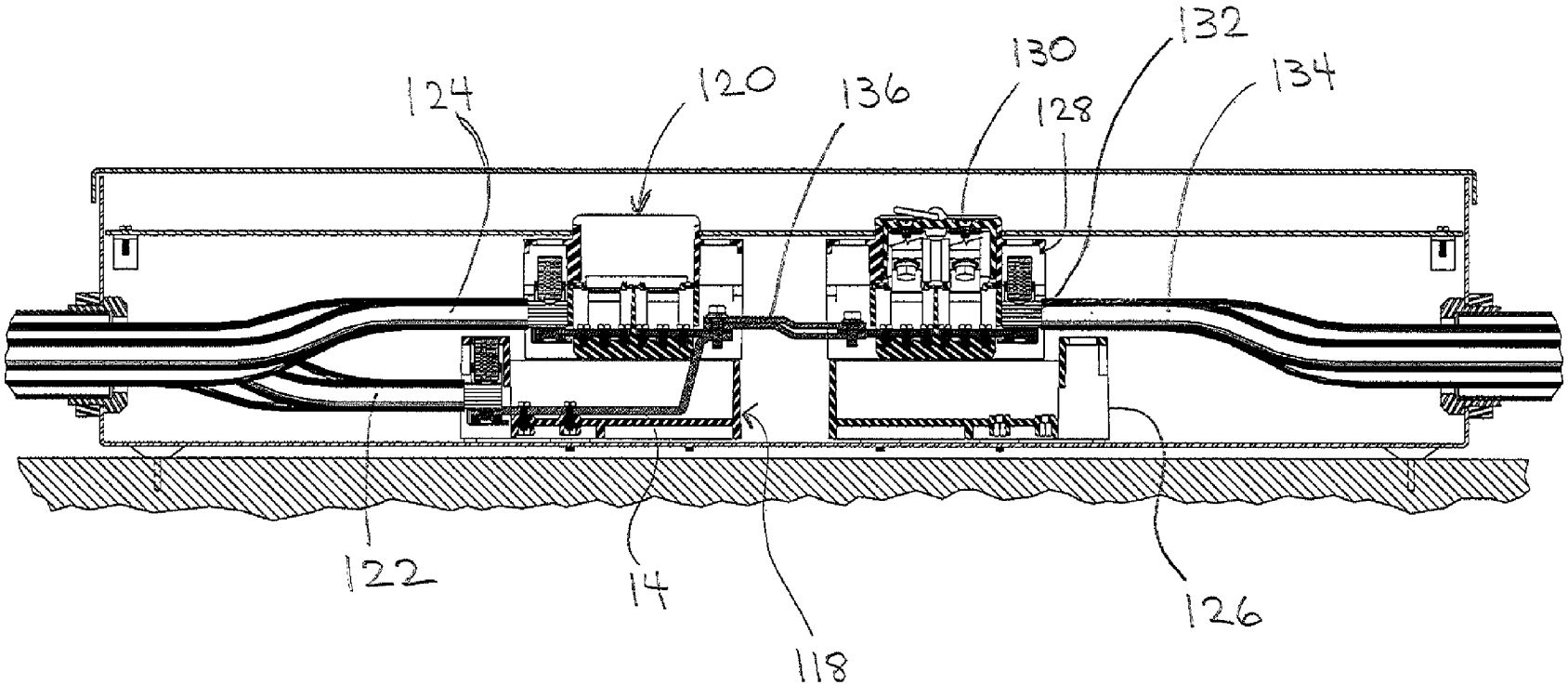
FIG. 18 is a cross sectional side elevation view of the assembly of FIG. 17.

FIGS. 17 and 18 illustrate how two terminal reversing blocks could be adapted to create a manual transfer switch. This embodiment has a terminal reversing block 118 with a pullout switch housing 120 mounted thereon as shown above. Input cables 122 are connected to the reversing block. Output cables 124 are connected to the switch housing 120 but the pullout switch housing 120 is shown without an insert section, such as that shown previously at 100. A second terminal reversing block housing 126 is provided with another pullout switch 128 mounted on it. Switch 128 does have an insert section 130 for shorting the contacts in the switch. Switch 128 also has output terminal collars 132 which connect to output cables 134. Terminal reversing block housing 126 lacks terminals and terminal collars. It simply provides a base for matching the height of pullout switch 128 with that of pullout switch housing 120. This enables the terminals 14 of reversing block 118 to be joined to the front contact of switch 128 by conductive straps or jumpers 136. With this arrangement the input cables 122 are electrically connected to one or the other of the sets of output cables 124 or 134, depending on the location of the one insert section 130. That is, if insert section 130 is placed as shown in switch 128 a connection is made between cables 122 and 134 via terminals 14, straps 136, and insert section 130 shorting the contacts in switch 128. No connection exists to output cables 124 due to the absence of an insert section to short the contacts in switch housing 120. If the insert section 130 is taken out of switch 128, doing so breaks the circuit to cables 134. If the insert section 130 is then placed in switch housing 120 it closes the circuit from the input cables 122 to the output cables 124.

Figure 19:
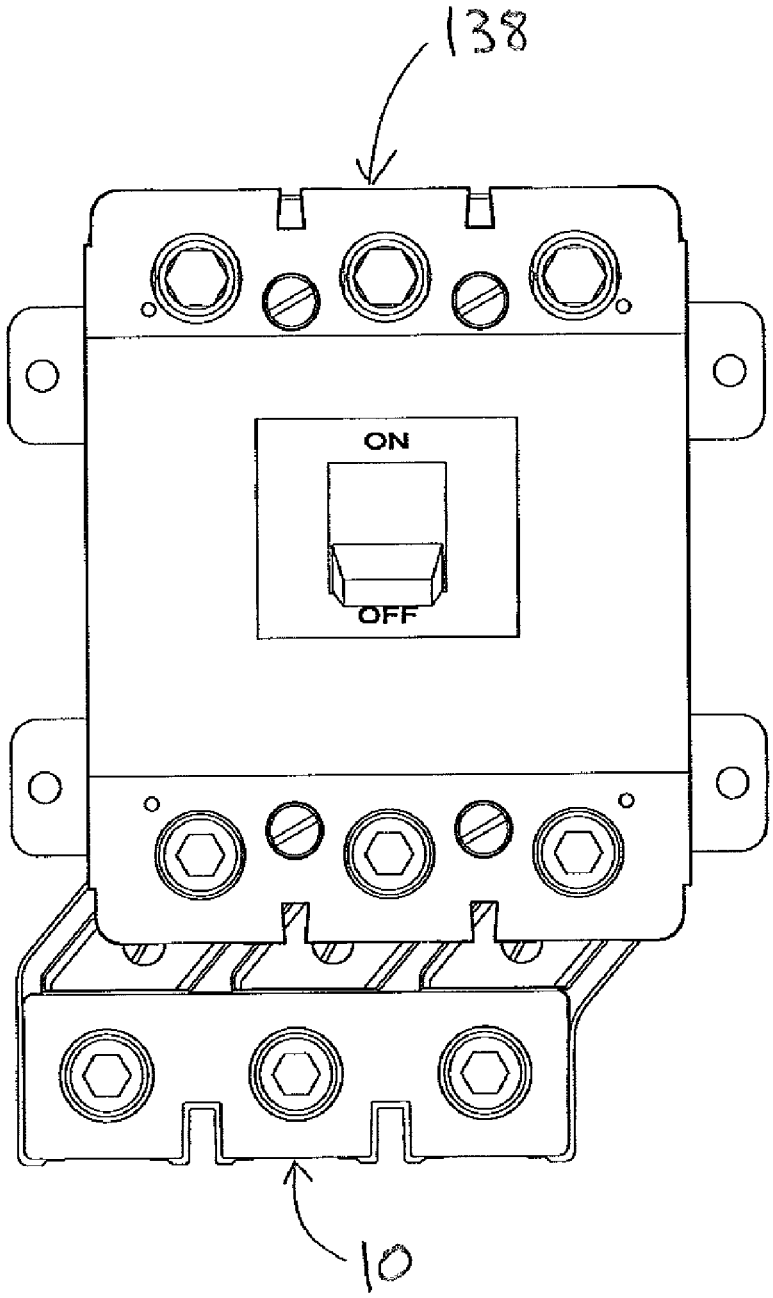
FIG. 19 is a top plan view of an alternate electrical disconnect device, in this instance a load switch, assembled on a terminal reversing block of the present invention.
Figure 20:
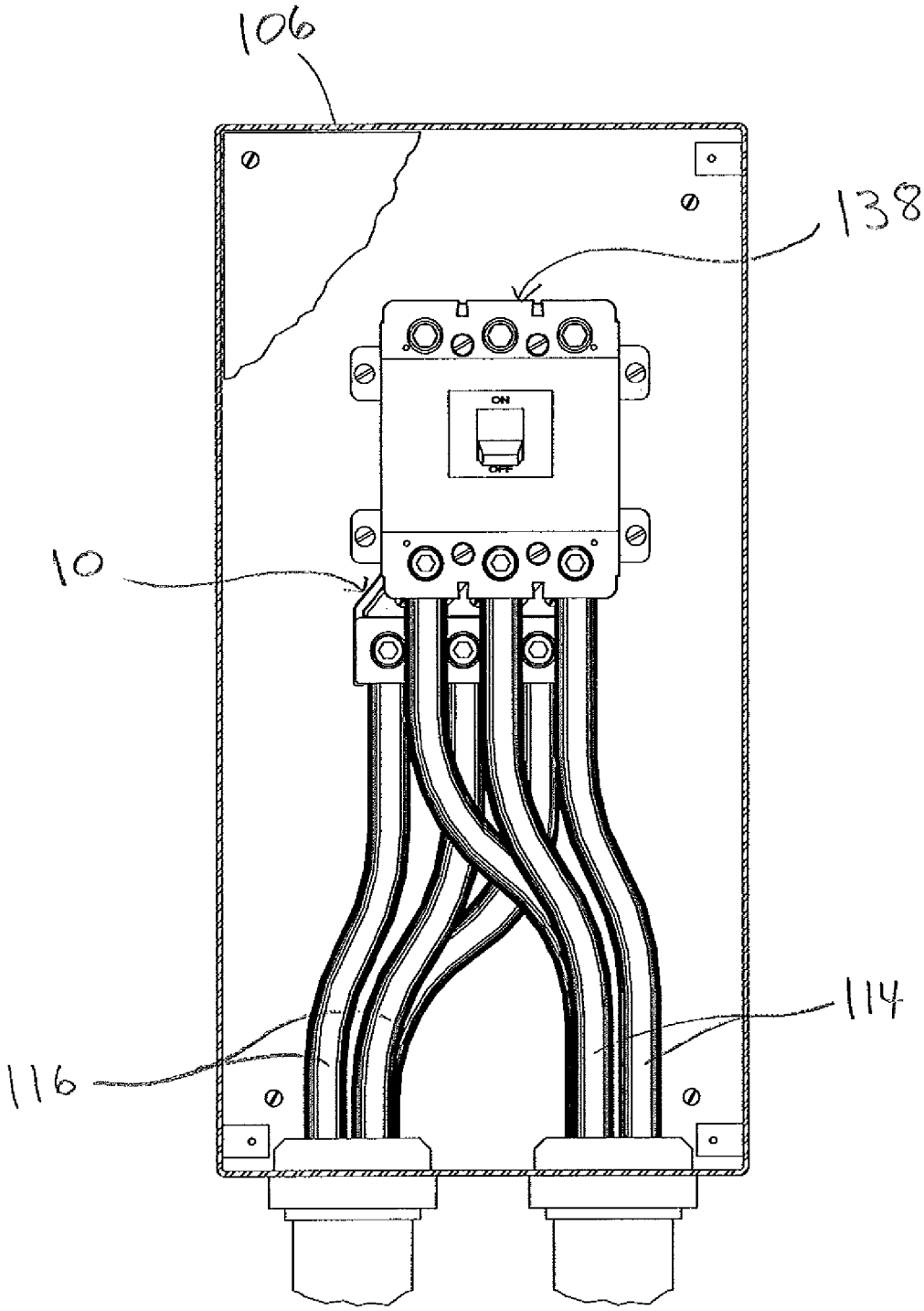
FIG. 20 is a top plan view of the electrical disconnect device assembly of FIG. 19 in an enclosure.
Figure 21:
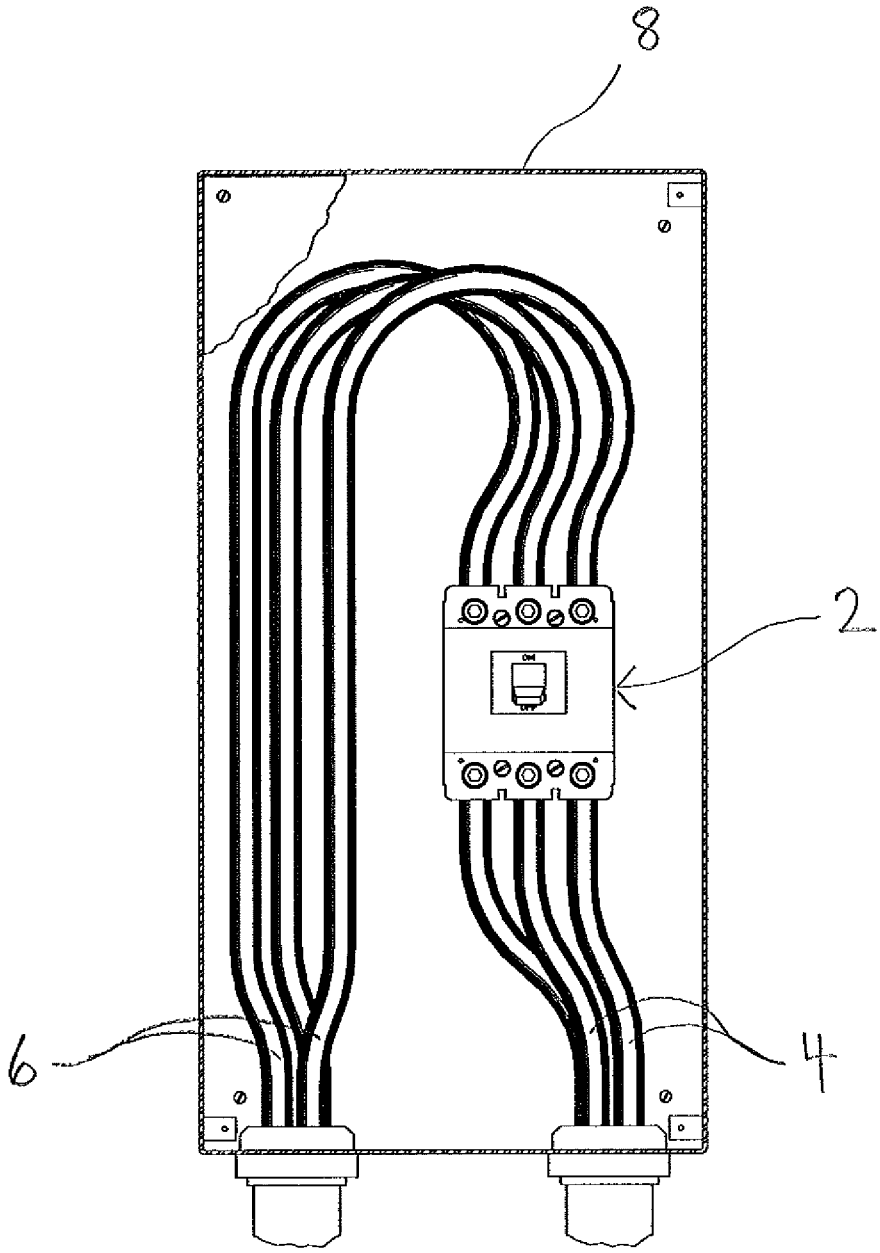
Prior Art Fig. 21
FIG. 21 is a top plan view of an electrical disconnect device in an enclosure, illustrating the prior art method of reversing the cables.

FIG. 19 illustrates another type of electrical disconnect device, in this case a load switch 138, mounted on a terminal reversing block 10. FIG. 20 shows load switch 138 and terminal reversing block 10 in an enclosure 106. Input and output cables both extend through the same end of the enclosure.

It is pointed out that the offset portion 68 of the terminal 14 results in the centerline of the terminal collars in the reversing block being laterally spaced from the centerline of the terminal collars in the disconnect device 88. This is best seen in FIG. 11 where the vertical centerline of a disconnect collar is indicated at plane C while the vertical centerline of a reversing block collar is indicated at plane D. This staggering of the terminal collars into individual, separate planes facilitates attaching cables to the assembly of a terminal reversing block and a disconnect device. The cables are more readily packed together with the offset arrangement of the reversing block's terminal collars compared to those of the disconnect device.

It will be understood that there are numerous modifications of the illustrated embodiments described above which will be readily apparent to one skilled in the art, such as many variations and modifications of the terminal reversing block and/or its components, including combinations of features disclosed herein that are individually disclosed or claimed herein, explicitly including additional combinations of such features. Also, there are many possible variations in the materials and configurations. These modifications and/or combinations fall within the art to which this invention relates and are intended to be within the scope of the claims, which follow. For example, instead of routing the output cables in the same direction as the input cables, in some instances it may be desirable to route the output cables perpendicular to the input cables. In this case the terminal reversing block would be configured to have its output terminal collars facing to one side of the housing. Also, while the terminal collar is a preferred device for maintaining a cable in contact with the connecting portion of the terminal, other arrangements could be used to hold the cable against the terminal. For example, an internally-threaded sleeve for receiving the clamping screw 86 could be mounted in the case portion of the housing and aligned with the collar-receiving pocket such that the clamping screw is engageable with a cable lying above the terminal's connecting portion 60. Finally, it will be understood that references to input and output cables are for purposes of distinguishing between two sets of cables and not for implying what the cables are connected to in the rest of the circuit. Thus, depending on the needs of a particular circuit, either an input or output cable could be connected to the line side of the circuit and either an input or output cable could be connected to the load side of the circuit.

The invention claimed is:

1. A terminal reversing block comprising:

a terminal block housing having at least one pocket and at least one terminal-receiving chamber defined in the terminal block housing, the terminal block housing having a terminal-receiving shell which is generally rectangular in shape with pair of side walls defining the long sides of the rectangle, the pocket and terminal-receiving chamber being laterally offset from one another in a direction perpendicular to the side walls;

a conductive terminal collar mounted in the pocket and electrically engageable with a cable inserted into the pocket; and a conductive terminal mounted in the terminal-receiving chamber and having a mating portion and a connecting portion, the connecting portion electrically engaging the terminal collar.

2. The terminal reversing block of claim 1 wherein the connecting portion defines an offset axis and the terminal further comprises a body portion defining a main axis, the body portion and connecting portion lying in the same plane and the main axis being spaced from the offset axis in a direction perpendicular to the side walls.

3. The terminal reversing block of claim 2 wherein the body portion comprises a flat trunk which defines the main axis and an offset portion between the flat trunk and the connecting portion.

4. The terminal reversing block of claim 3 wherein the body portion further comprises a neck extending out of the plane of the trunk, the neck being connected to the mating portion.

5. The terminal reversing block of claim 1 wherein the pocket of the terminal reversing block faces in the same direction as the connecting portion.

6. An electrical disconnect assembly, comprising:

an electrical disconnect device having a housing with front and rear contacts therein, a bridging member selectably electrically engageable with the front and rear contacts, and the housing defining a cavity into which one of the front and rear contacts extends for electrical engagement with a first cable inserted therein, the cavity facing in one direction;

a terminal reversing block having a terminal block housing with at least one pocket defined therein, the pocket facing in a direction other than the opposite of the direction in which the disconnect device's cavity faces; and a conductive terminal mounted in the terminal block housing and having a mating portion and a connecting portion, the connecting portion being electrically engageable with a second cable inserted into the pocket, and the mating portion electrically engaging the other of the front and rear contacts of the electrical disconnect device.

7. The electrical disconnect assembly of claim 6 wherein the electrical disconnect device is a circuit breaker.

8. The electrical disconnect assembly of claim 6 wherein the electrical disconnect device is a pullout switch.

9. The electrical disconnect assembly of claim 6 wherein the electrical disconnect device is mounted on top of the terminal reversing block.

10. The electrical disconnect assembly of claim 6 wherein the connecting portion defines an offset axis and the terminal further comprises a body portion defining a main axis, the main axis being spaced from the offset axis.

11. A manual transfer switch, comprising:

a first electrical disconnect device having a first housing with first front and rear contacts therein, the first housing defining a well for selectably receiving a bridging member, and the first housing defining a first cavity into which one of the first front and rear contacts extends for electrical engagement with a first cable inserted therein;

a second electrical disconnect device having a second housing with second front and rear contacts therein, the second housing defining a well for selectably receiving a bridging member, and the second housing defining a second cavity into which one of the second front and rear contacts extends for electrical engagement with a second cable inserted therein;

a bridging member selectably insertable into one of the wells of the first and second electrical disconnect devices, the bridging member when inserted into a well being electrically engageable with the front and rear contacts of the one of the first and second electrical disconnect devices in which the bridging member is inserted to electrically connect said front and rear contacts;

a terminal reversing block having a third housing with at least one pocket defined therein;

and;

a conductive terminal mounted in the third housing and having a mating portion and a connecting portion, the connecting portion being electrically engageable with a third cable inserted into the pocket, and the mating portion electrically engaging one of the front and rear contacts of one of the electrical disconnect devices; and a conductive strap electrically connecting the terminal to one of the front and rear contacts of the other of the electrical disconnect devices.

12. A terminal reversing block comprising:

a terminal block housing having at least one pocket;

a conductive terminal mounted in the terminal block housing and having a mating portion, a body portion and a connecting portion, the body portion including a trunk and an offset portion, the connecting portion having top and bottom faces connected by side and end edges, the width of the top and bottom faces being greater than the height of the side and end edges, the top face of the connecting portion defining a reference plane, the connecting portion being electrically engageable with a cable inserted into the pocket, and the trunk, offset portion and connecting portion lying in the reference plane and wherein the connecting portion defines an offset axis and the trunk defines a main axis, the main axis being spaced from the offset axis in the reference plane.

13. The terminal reversing block of claim 12 wherein the body portion comprises a flat trunk which defines the main axis and an offset portion between the flat trunk and the connecting portion.

14. The terminal reversing block of claim 13 wherein the body portion further comprises a neck extending out of the plane of the trunk, the neck being connected to the mating portion.

15. The terminal reversing block of claim 12 wherein the pocket of the terminal reversing block faces in the same direction as the connecting portion.

16. The terminal reversing block of claim 12 wherein the pocket of the terminal reversing block is laterally offset from the body portion.

17. An electrical disconnect assembly, comprising:

an electrical disconnect device having a housing with front and rear contacts therein, a bridging member selectably electrically engageable with the front and rear contacts, and the housing defining on one side thereof a cavity into which one of the front and rear contacts extends for electrical engagement with a first cable inserted therein;

a terminal reversing block having a terminal block housing supporting the disconnect device and having on one side thereof at least one pocket defined therein, the pocket being defined on the same side of the terminal block housing as the disconnect device's cavity; and a conductive terminal mounted in the reversing block housing and having a mating portion and a connecting portion, the connecting portion being electrically engageable with a second cable inserted into the pocket, and the mating portion electrically engaging the other of the front and rear contacts of the electrical disconnect device.

18. The terminal reversing block of claim 17 wherein the connecting portion defines an offset axis and the terminal further comprises a body portion defining a main axis, the main axis being spaced from the offset axis.

19. The terminal reversing block of claim 18 wherein the body portion comprises a flat trunk which defines the main axis and an offset portion between the flat trunk and the connecting portion.

20. The terminal reversing block of claim 19 wherein the body portion further comprises a neck extending out of the plane of the trunk, the neck being connected to the mating portion.

* * * * *